United States Patent [19]

Yamazaki

[11] 4,072,021

[45] Feb. 7, 1978

[54] METHOD OF DRIVING AND FORMING A TUNNEL WITH HYDRAULIC BORING MACHINE

[75] Inventor: Hironobu Yamazaki, Kashiwa, Japan

[73] Assignee: Tekken Construction Co. Ltd., Tokyo, Japan

[21] Appl. No.: 738,271

[22] Filed: Nov. 2, 1976

[51] Int. Cl.[2] ..... E01G 5/04

[52] U.S. Cl. ..... 61/42; 61/84; 61/85

[58] Field of Search ..... 61/84, 85, 42, 63, 45 R; 299/31-33

[56] References Cited

U.S. PATENT DOCUMENTS

| | | | |
|---|---|---|---|
| 360,959 | 4/1887 | Greathead | 61/85 |
| 1,235,233 | 7/1917 | O'Rourke | 61/84 |
| 3,260,054 | 7/1966 | Lorenz | 61/42 |
| 3,334,945 | 8/1967 | Bartlett | 61/85 X |
| 3,561,223 | 2/1971 | Tabor | 61/85 |
| 3,640,076 | 2/1972 | Rees et al. | 61/42 |
| 3,830,545 | 8/1974 | Sugden | 61/85 X |

FOREIGN PATENT DOCUMENTS

| | | | |
|---|---|---|---|
| 1,244,222 | 7/1967 | Germany | 61/85 |
| 168,126 | 8/1921 | United Kingdom | 61/85 |

*Primary Examiner*—Dennis L. Taylor

*Attorney, Agent, or Firm*—Burns, Doane, Swecker & Mathis

[57] ABSTRACT

A tunnel driving and forming method with hydraulic boring machine through mixed ground of stable and unstable layers which is simplified in equipments, less in air contamination and noises and high in working accuracy. The method comprises steps of driving the hydraulic boring machine into the ground to bore a tunnel therein, installing segments sequentially against bored tunnel wall right behind the machine as the same advances, impregnating a back-filling agent between said bored tunnel wall and outer periphery of installed segments, removing the rearmost set of a certain number of sets of said installed segments behind the machine for circulatory use as long as the ground bored is stable, reinforcing exposed surface of said back-filling agent impregnated and set, and repeating respective said steps responsive to advances of the machine. The removed sets of the segments are normally circulatorily used as sequentially installed at the foremost position of said certain number of sets adjacent tail end of the machine so long as the ground being bored is stable but, when an unstable ground layer is reached, the installed segments at the position facing such unstable layer are remained as installed so as to be a reinforcing wall for the unstable layer.

6 Claims, 3 Drawing Figures

METHOD OF DRIVING AND FORMING A TUNNEL WITH HYDRAULIC BORING MACHINE

This invention relates to improvements in methods of driving and forming a tunnel with hydraulic tunnel boring machine through mixed ground involving stable and unstable layers.

In boring a tunnel in such a ground rather dry and stable as bedrock, clay layer or the like having little risk of gushing water, there have been defects that, as the drilling with rock-drills and blasting are repeated, noises will be generated, special conveying equipments will be required to discharge excavated rocks and the like, the air in the tunnel will be polluted with finely crushed rocks and the like and, therefore, ventilating equipments will be required, such various equipments render the interior of the tunnel to become complicated, the progress of the work will not be smooth and many workers other than tunneling workers at the tunnel face will be required for such various equipments. Futher, when such unstable or risky ground layer as, for example, an underground water layer, high water content layer, running sand layer or the like is encountered in the course of a tunnel boring, the risk of accidents by gushing water or ground layer collapse in the tunnel face or tunnel will be so high that special preventive measures only for such layer will have to be taken, which will apparently delay the work and increase the costs. The present invention has been suggested to remove such defects in the conventional methods.

A primary object of the present invention is to provide a method of driving and forming tunnels wherein the equipments within the tunnel are simplified.

Another object of the present invention is to provide a method of driving and forming tunnels wherein the generation of noises is little.

A further object of the present invention is to provide a method of driving and forming tunnels wherein the pollution of air is little.

Another object of the present invention is to provide a method of driving and forming tunnels wherein a tunnel can be easily and safely driven and formed even in a ground in which the ground condition varies in respect of such risks as gushing water, ground collapse and the like.

Other objects and advantages of the present invention will be made clear upon reading the following explanation of the present invention detailed with reference to preferred embodiments shown in the accompanying drawings, in which.

It should be understood here that the intention is not to limit the present invention to the particular embodiments as shown, but rather to include all alterations, modifications and equivalent arrangements possible within the scope of the appended claims.

Figure 1:
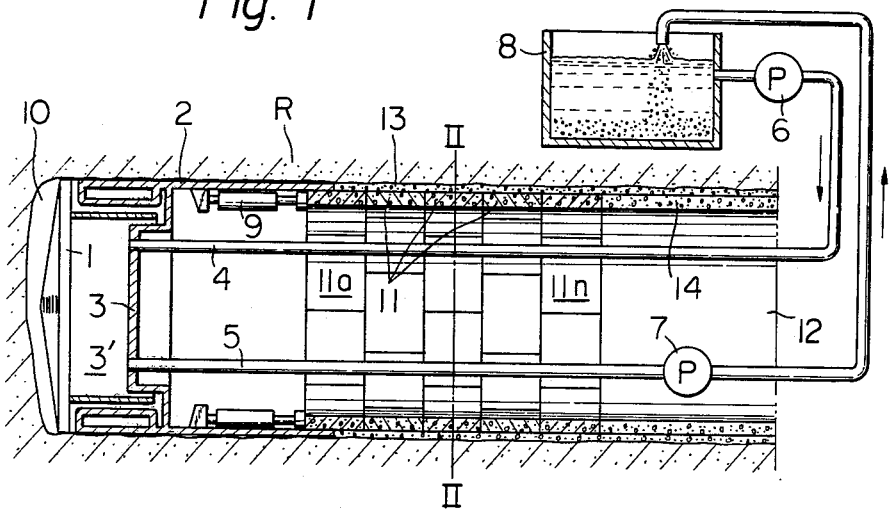
FIG. 1 is a schematic sectioned view of a tunnel being driven and formed with a tunnel boring machine of hydraulic shield type according to the method of the present invention for a dry or stable bedrock.

Referring first to the structure of a hydraulic tunnel boring machine to be used in the present invention with reference to FIG. 1, the tunnel boring machine is provided with a cutter head 1 at the front end of a substantially cylindrical shield body 2 and this cutter head 1 is rotatable around axial line of said body 2 and driven by a rotating mechanism (not illustrated). Further, a liquid-tight and pressure-resisting bulkhead 3 is provided inside the body 2 and behind the cutter head 1, so that a hydraulic chamber 3' communicating with the tunnel face 10 through the cutter head 1 will be formed in the head part of the shield body 2. This hydraulic chamber 3' is provided with a feeding pipe 4 for feeding generally water under a pressure into the hydraulic chamber 3' and further through the bulkhead 3 to the tunnel head 10, and with a discharging pipe 5 for discharging crushed rock pieces or the like of the ground drilled by the cutter head 1 together with the water out of the tunnel also through the bulkhead 3. These pipes 4 and 5 are connected respectively through pumps 6 and 7 to a tank 8 generally installed on the ground surface for reserving the discharged water with the crushed rocks or the like and supplying water separated therein from the crushed rocks or the like again to the feeding pipe 4. The shield body 2 is provided with a plurality of propelling jacks 9 fixed on their cylinder side to the shield body 2 along the inner peripheral surface of the body so as to pay out their plungers toward the rear end in reverse direction to the cutter head. As described later, the shield body 2 is propelled in the boring direction by these jacks 9.

Next, the method of the present invention shall be explained with reference to FIGS. 1 and 2. When the cutter head 1 of the tunnel boring machine is rotated while feeding water under a pressure to the tunnel face 10 from the hydraulic chamber 3' and the plungers of the propelling jacks 9 in contact with the end surface of later described fixed tunnel wall segments are payed out, the machine will be propelled toward the tunnel face 10 so as to drive a tunnel into, in the present instance, a bedrock R having little risk of gushing water. So long as no water gushes on the tunnel face, the pressure to be applied to feeding water will be sufficient with a comparatively low pressure required only fo the hydraulic boring and smooth discharge of crushed rock pieces or the like, but it is desirable that the amount of fed water is to be enough for substantially filling the whole space in the hydraulic chamber 3' and tunnel face 10. When water gushes or such risk is preliminarily known a hydraulic pressure which can well resist the underground water pressure in the ground layer to be bored should be maintained so that the obstruction to the progress of the boring and the danger of the ground collapse by gushing water will be restrained by the pressurized water. The crushed rocks or the like of the drilled ground R will be discharged together with the water out of the tunnel face once to the tank 8 through the discharging pipe 5 and further out of the tank as separated from water.

With the progress of the boring with the tunnel boring machine, a certain number of sets of tunnel wall segments 11 made, for example, of a concrete for reinforcing the tunnel wall are cylindrically assembled and fixed along the inside surface of the bored tunnel. A back-filling such as, for example, a mortar 13 is impregnated through impregnating ports (not illustrated) provided preferably in the segments 11 into air gap remaining between the inner periphery of the bored tunnel 12 and the outer peripheries of the segments 11. In the case of a ground having little risk of gushing water, the rearmost set 11*n* of the wall segments in the position where the mortar 13 has well set is removed from the bored tunnel 12 and a quick setting concrete 14 is preferably sprayed so as to be a tunnel wall base. A timbering preferably made of steel may be assembled as required instead of the sprayed concrete 14. The removed set 11*n* of the segments is moved to the foremost position overlapping the rear end of the shield body 2 so as to be sequentially circulatorily reused. In the case of using this bored tunnel 12 itself as a main tunnel, the tunnel wall base according to the present invention is finished on the surface of the sprayed concrete 14 or the assembled timbering but, in the case of using this tunnel as a heading, the tunnel wall base of the sprayed concrete 14 may be used as it is.

In propelling the tunnel boring machine with the before described propelling jacks 9, the plungers of these jacks are brought at the extruded ends into contact with the end edge surface of the foremost set 11*a* of the segments positioned immediately at the rear end of the shield body 2 and are payed out so as to push the shield body 2 toward the tunnel face 10.

Figure 3:
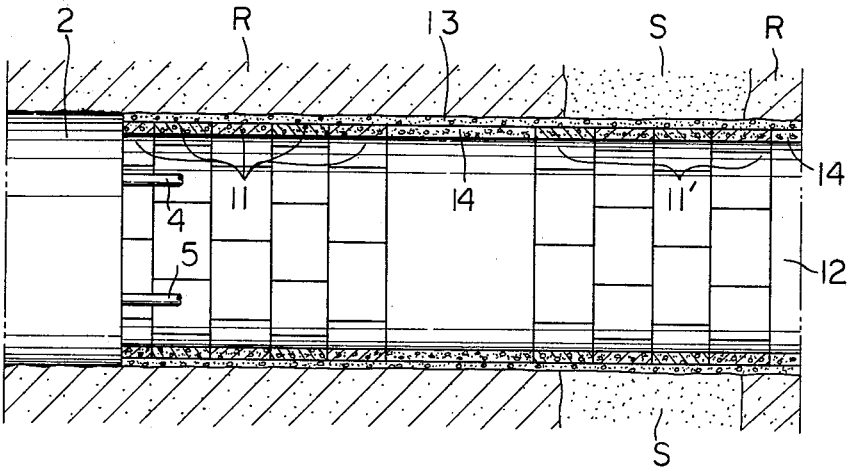
FIG. 3 is a schematic sectioned view of a tunnel being bored and formed in a bedrock including such an unstable ground layer as a running sand layer according to the present invention.

Next, the method of driving and forming tunnels according to the present invention employed in the case when such an unstable layer as a high water content layer having the risk of gushing water, running sand layer or the like exists in the bedrock R to be tunneled shall be explained with reference to FIG. 3, in which the unstable layer is shown as a running sand layer S, as an example. The water under a pressure which can resist the gushing water pressure or ground pressure is fed to the tunnel face 10 before and during the boring through the layer S so as to continue the boring through such unstable sand layer S restraining its running with the hydraulic pressure. The concrete wall segments 11 are sequentially installed behind the shield body 2 as the machine advances in the similar manner to the case of FIG. 1 and the mortar 13 is also impregnated around the installed segments. When the rear end of the machine's shield body 2 has reached the bedrock R lying beyond the sand layer S, the installed sets of the segments 11 are removed for the reuse at the foremost position right behind the shield body 2 and the quick setting concrete 14 is sprayed against the exposed mortar 13 but, in the present instance, the installed segments 11' in the part of the running sand layer S is not removed but is remained as installed so that any risk of the sand layer's collapse possibly occurring when the segments are removed will be avoided.

Figure 2:
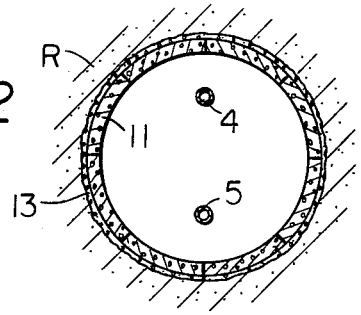
FIG. 2 is a sectioned view on line II—II in FIG. 1.

While in the foregoing disclosures of the respective embodiments of FIGS. 1 and 2 the mortar impregnation has been referred to as performed directly around the concrete wall segments, it will be preferable to provide, as required, an additional layer of a strip-promoting agent or material on the outer periphery of the concrete wall segments for the purpose of preventing the impregnated mortor from adhering to the segments, so that the mortar may be easily stripped off from the segments when they are removed for the circulatory use.

Featured advantages according to the present invention are as follows:

(i) As even a bedrock is crushed into small pieces with the rotary cutter head and hydraulic pressure and the crushed rocks are conveyed hydraulically out of the tunnel through the discharging pipe, the equipments in the tunnel will be simple and the air pollution and unpleasant noise generation can be effectively prevented.

(ii) As the concrete wall segments can be repeatedly used and the tunnel wall may be reinforced by a sprayed concrete, the work cost can be reduced remarkably.

(iii) As the front section of the tunnel being bored is reinforced by the concrete wall segments which provide a rigid and smooth surface, an accurate setting and orientation of the tunnel boring machine with respect to the center level of the tunnel can be achieved in a simple and easy manner. In this connection, any problems of snaking and pitching of the tunnel boring machine caused by a reaction taken on the ground by gripper jacks for propelling the machine projecting toward lateral sides with respect to the axial line of the tunnel in the conventional tunnel boring can be solved.

(iv) The method of the present invention provides a higher precision in tunnel wall partitioning performance since the intimately installed concrete wall segments are employed.

(v) Apart from the hydraulic drilling and conveying of the ground and crushed ground stuff of the present invention, the circulatory usage of the tunnel wall concrete segments can be commonly applied to the tunnel boring of any conventional method.

What is claimed is:

1. A tunnel driving and forming method with hydraulic boring machine through mixed ground of stable and unstable layers comprising steps of driving said machine into said ground to bore a tunnel therein, installing segments sequentially against bored tunnel wall right behind the machine as the same advances, impregnating a back-filling agent between said bored tunnel wall and outer periphery of said segments installed, removing the rearmost one of a plurality of sets of said installed segments behind the machine as long as the ground is stable, reinforcing the bored tunnel wall with respect to exposed surface of said back-filling agent impregnated and set, and repeating respective said steps responsive to advances of the machine, said step of removing the rearmost set of installed segments being suspended during an interval when an unstable layer in the ground is being bored and until next stable layer is reached so that the installed segments at the position facing said unstable layer remain for reinforcing the tunnel wall of said position.

2. A method according to claim 1 wherein said step of reinforcing the bored tunnel wall comprises a step of spraying a quick setting concrete against said surface of the back-filling agent.

3. A method according to claim 1 wherein said step of reinforcing the bored tunnel wall comprises a step of providing a timbering against said surface of the back-filling agent.

4. A method according to claim 1 wherein said segments are respectively provided on the outer periphery with a layer for promoting stripping-off of the segments from said back-filling agent impregnated and set.

5. A method of boring a tunnel in a mixed ground of stable and unstable layers with a shield type tunnel boring machine having a hydraulic pressure chamber behind a rotary cutter head and a plurality of machine propelling jacks secured along inner periphery of shield body of the machine to project their plungers toward tail end of said body, the method comprising steps of hydraulically boring the ground with said rotary cutter head while feeding a pressurized water to tunnel face through said hydraulic pressure chamber and rotary cutter head and discharging said water with crushed ground stuff out of said tunnel face to the exterior, installing segments contiguous to said tail end of the machine body for reinforcing bored tunnel wall, abutting plunger ends of said jacks against an end edge of said installed segments on the side of the machine, propelling the machine in the direction of boring the tunnel as the boring advances by paying out the plungers of the jacks, further installing a plurality of sets of segments sequentially one by one contiguous to the machine's tail end as the machine is propelled, impregnating a back-filling agent between bored tunnel wall and outer periphery of said installed segments, removing the rearmost one of said plurality sets of the segments sequentially as the machine advances so long as the ground being bored is of a stable layer, and providing a reinforcing means to exposed surface of said back-filling agent on the bored tunnel wall, said step of sequentially removing the rearmost set of segments being suspended where the ground is unstable so that the segments will remain and function as said reinforcing means for the unstable ground.

6. A method according to claim 5 wherein said pressurized water is maintained at least to be of a pressure enough for restraining an unstable ground layer to be stable at least when such layer is encountered.

* * * * *